US006164701A

United States Patent [19]

Mürl

[11] Patent Number: 6,164,701

[45] Date of Patent: Dec. 26, 2000

[54] NUMBERING APPARATUS FOR DOCUMENTS, AND NUMBERED DOCUMENTS

[75] Inventor: Gerhard Mürl, Wasserburg/Inn, Germany

[73] Assignee: Diesecke & Devrient GmbH, Germany

[21] Appl. No.: 08/912,638

[22] Filed: Aug. 18, 1997

[30] Foreign Application Priority Data

Aug. 19, 1996 [DE] Germany ..... 196 33 394

[51] Int. Cl.[7] ..... B42D 15/00

[52] U.S. Cl. ..... 283/57; 101/45; 101/76; 101/83; 101/111; 283/53; 283/58; 283/59; 283/99

[58] Field of Search ..... 283/53, 56, 57, 283/58, 59, 65, 99; 101/45, 76, 83, 111

[56] References Cited

U.S. PATENT DOCUMENTS

| | | | |
|---|---|---|---|
| Re. 33,802 | 1/1992 | Whitehead et al. | 283/58 |
| 1,378,673 | 5/1921 | Graton . | |
| 2,842,054 | 7/1958 | Monger . | |
| 3,159,101 | 12/1964 | Dziekan | 101/111 |
| 3,363,548 | 1/1968 | Aijima | 101/83 |
| 3,757,688 | 9/1973 | Weber | 101/45 |
| 4,207,814 | 6/1980 | Schenk | 101/76 |
| 4,645,240 | 2/1987 | Whitehead et al. | 283/57 |

FOREIGN PATENT DOCUMENTS

| | | |
|---|---|---|
| 0 160 504 | 11/1985 | European Pat. Off. . |
| 134737 | 12/1919 | United Kingdom . |

*Primary Examiner*—Daniel W. Howell
*Assistant Examiner*—Monica Carter
*Attorney, Agent, or Firm*—Bacon & Thomas PLLC

[57] ABSTRACT

To improve the security in data carriers, such as papers of value, bank notes, ID cards, etc., a numbering apparatus is proposed for individualizing the data carrier whereby the characters are engraved in the engraved blocks present on the numbering apparatus such that the serial number extends along a line having a curvature.

18 Claims, 5 Drawing Sheets

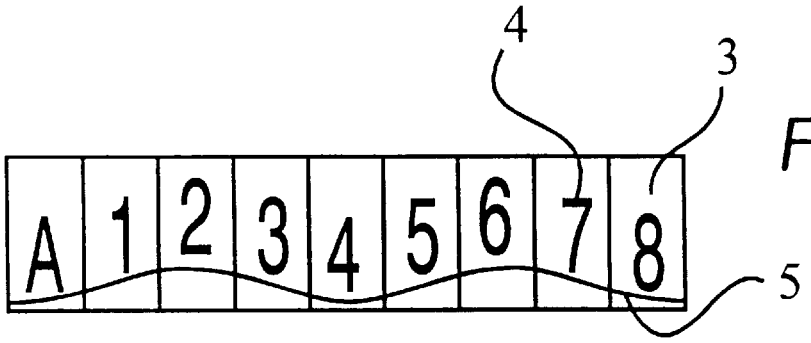
FIG. 4(a)
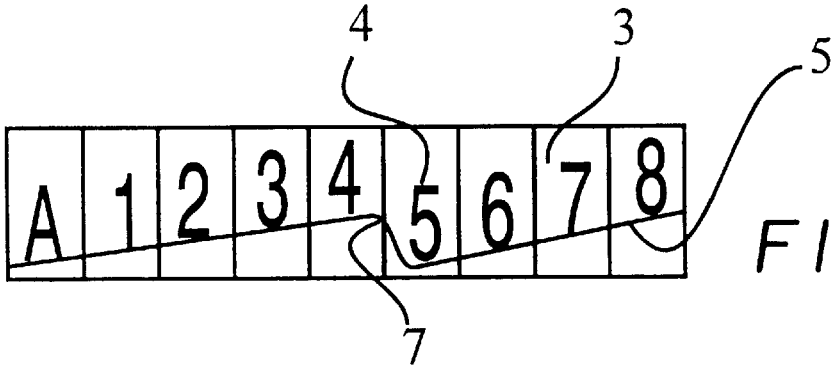
FIG. 4(b)
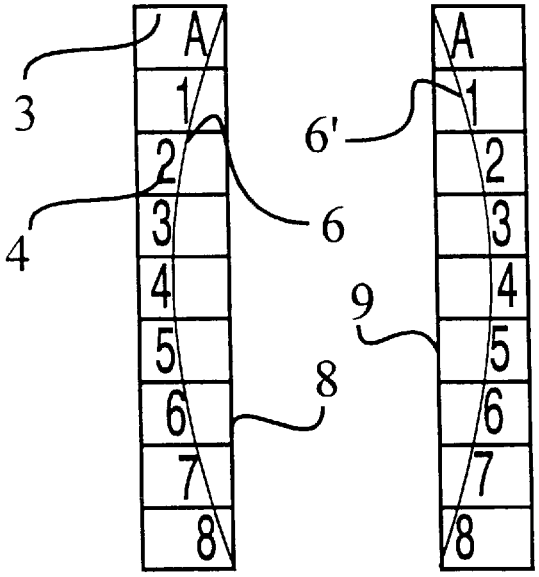
FIG.5(b)
FIG.5(a)

NUMBERING APPARATUS FOR DOCUMENTS, AND NUMBERED DOCUMENTS

BACKGROUND OF THE INVENTION

1. Field of the Invention

This invention relates to a data carrier, in particular paper of value, bank note, ID card, credit card, telephone card or the like, having a serial number consisting of several characters which uniquely individualizes the data carrier from a series of data carriers, and to a numbering apparatus for numbering the data carriers.

2. Related Technology

To increase security and to identify documents, for example bank notes, checks, ID cards, credit cards or the like, one applies consecutive numbering, usually printing this so-called "serial number" on the completed data carrier. For applying the serial number to the data carriers one uses for example a numbering unit placed in a numbering station which the documents pass through for numbering.

DE-OS 1 486 894 discloses a numbering printing unit for providing such documents with a consecutive serial number. This multidigit number can be provided on the document several times and be applied horizontally or vertically, the number being printed with a special ink, for example a magnetic ink.

To increase security in documents of value, EP 0 061 795 B1 further proposes providing the printed serial number with an additional code number which varies with the consecutive numbering and is printed in a different color from the serial number.

For further improving the security of numbered documents, EP 0 160 504 B1 has proposed designing the serial number so that at least two characters of the serial number differ in height, width, type font or in a combination of these properties.

The invention is based on the problem of proposing a numbering apparatus and documents numbered with this numbering apparatus whereby the security of the documents is improved by the numbering with the numbering apparatus.

This problem is solved by the features of the independent claims.

SUMMARY OF THE INVENTION

The essence of the invention is based on the finding that the security of documents can be improved considerably if one numbers them or applied serial number indicia using numbering units whose figures or characters have a special arrangement relative to each other when forming a serial number, this arrangement following an imaginary, visible or otherwise detectable line having a curvature.

This special arrangement of the figures or characters relative to each other ensures that the original numbering of the documents can only be performed with the specially produced numbering units. Subsequent precisely fitting replacement of an individual figure or characters of the numbering is impeded considerably since the line along which the characters of the serial number are disposed does not extend in a straight line. For numbering the documents one uses a numbering unit wherein the characters of the serial number are offset relative to each other on the engraved character blocks so as to be disposed along an imaginary, visible or detectable curved line. With such numbering units the offset can be stated relative to an edge of the engraved block or relative to a reference line of a character. For serial numbers which have characters disposed horizontally side by side, the offset can be characterized for example in that the characters are engraved at different heights relative to the lower edge of the engraved block, so that the baseline on which the characters are aligned is curved. When engraving the characters one must additionally take into account that some characters do not stand directly on the baseline but are disposed at a defined distance therefrom, for example hyphens, dashes or the numerals 5 and 0 in the Arabic speech area.

If characters of a serial number stand upright one above the other, however, a different distance of the characters from a lateral edge of the engraved block can be used for producing the arrangement along an imaginary, visible or detectable curved line.

Since such numbering units must be specially produced for numbering documents and their production necessitates special tools and special knowledge, the security of documents numbered with these numbering units is considerably increased.

BRIEF DESCRIPTION OF THE DRAWINGS

Further advantages and advantageous developments are the object of the following description of the figures, which dispense with a true-to-scale representation for clarity's sake.

FIGS. 4*a–b* shows a schematized arrangement of the figures on the engraved blocks of a numbering apparatus, FIGS. 5*a–b* shows a schematized arrangement of the figures on the engraved blocks of a numbering apparatus.

DETAILED DESCRIPTION OF THE INVENTION

Figure 1:
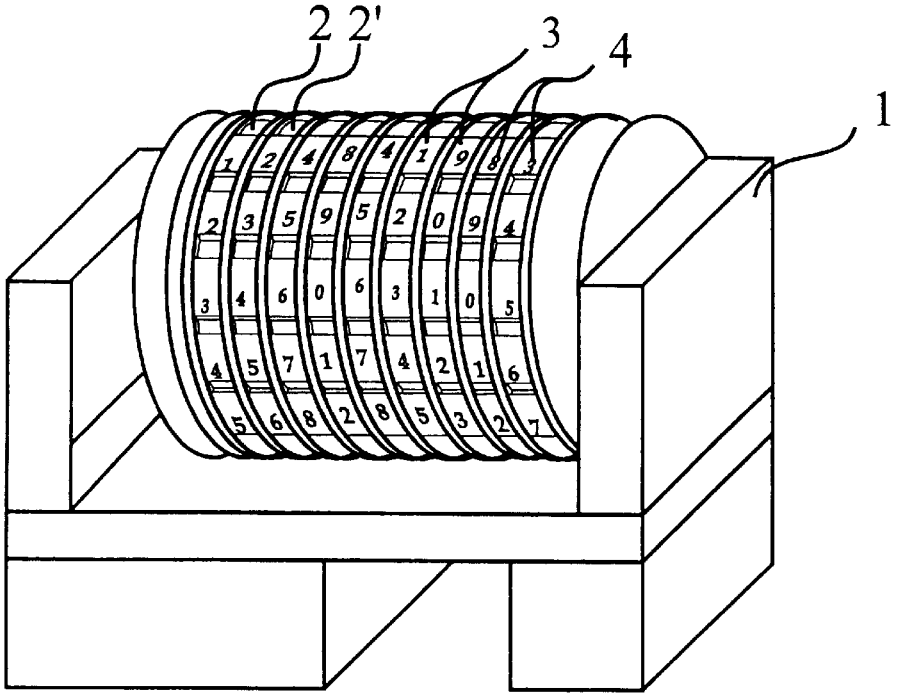
FIG. 1 shows a schematic representation of an inventive numbering apparatus.

FIG. 1 shows schematically serial number imprinting or numbering apparatus 1 having figure wheels 2, 2' bearing in the particular direction of rotation of the figure wheels engraved character blocks 3 on which characters 4 of the serial numbers are engraved. The engraved characters can be basically any characters, for example numerals, letters, symbols or other characters suitable for individualization. A switching mechanism not shown in the Figure ensures that the numbering unit is switched in accordance with the desired numbering to form a serial number. Characters 4, which are applied to blocks 3 horizontally side by side in the present numbering unit, are offset relative to each other on engraved blocks 3 such that the serial number follows an arc shape and a serial number printed on a data carrier with this numbering apparatus accordingly extends in an arc shape. The arrangement of a serial number along a line having a curve is ensured with the present numbering apparatus in that characters 4 of the serial number are disposed on engraved blocks 3 at a defined distance from the lower edge of engraved block 3. This distance is constant for figures with the same height on one and the same figure wheel. In the present case this distance is varied in defined fashion from figure wheel to figure wheel, giving rise to the arrangement of the figures along an imaginary curved line. Although the distance of the figures on the embossed block from the lower edge of the embossed block can be different on each figure wheel, it suffices for the inventive numbering unit if this distance from an edge of the engraved block is varied on at least one figure wheel.

Figure 2:
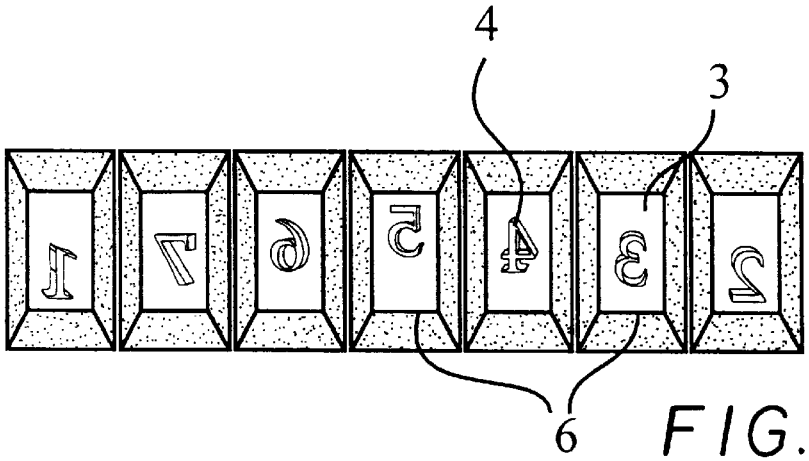
FIG. 2 shows a plan view of the embossed blocks of a numbering apparatus.

To illustrate the engraved relations more clearly, FIG. 2 shows a schematized detail from numbering apparatus 1 indicating engraved blocks 3 disposed side by side bearing characters 4 as raised engraved characters. In their position on the engraved blocks the characters differ in the present case by a vertical offset which is constant between each character, so that the serial number formed by the characters follows an imaginary line which is curved and is represented in the present case by an arc 5. For characters which usually stand on the same line, i.e. whose feet are on a line, this offset can be characterized in that the distance between the foot of engraved character 4 and the lower edge of engraved block 6 on which the character is engraved is different with at least two of these characters of the serial number. As to be seen in FIG. 2, this distance increases for the first characters of the serial number and decreases for the last characters of the serial number, resulting altogether in an arrangement of the serial number along an imaginary curved line. The numbering apparatus accordingly has engraved blocks disposed side by side wherein at least one engraved character is disposed so as to be offset from a straight connecting line from the foot of the first character to the foot of the last character. For characterizing the offset one can use not only the straight connecting line from the foot of the first to the foot of the last character but also the straight connecting line from the head of the first to the head of the last character.

FIG. 1 shows the characters of the serial number as positively recognizable characters, but in such numbering apparatuses the characters are usually cut as raised reliefs from the embossed blocks, as to be seen in FIG. 2. When the serial number is printed using this numbering apparatus, the characters are transferred to the document true to side, the serial number being disposed along a line having a curvature according to the invention.

Figure 3:
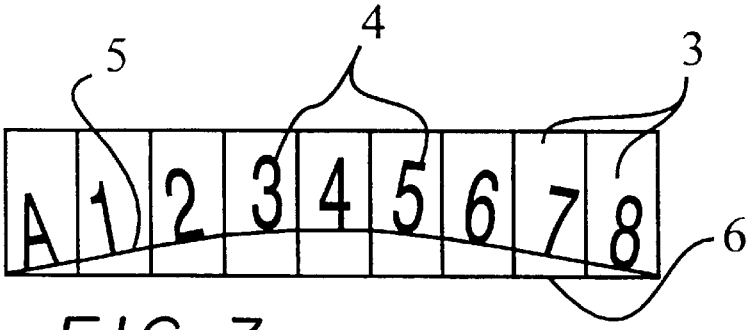
FIG. 3 shows a schematized arrangement of the figures on the engraved blocks of a numbering apparatus.

FIG. 3 shows a further embodiment indicating how the serial number can be disposed along a curved line. Engraved blocks 3 are shown further schematized and characters 4 of the serial number represented positively for clarity's sake. One can likewise see normally invisible curve 5 along which the serial number extends. In this embodiment each character of the serial number is normal to a tangent applied to imaginary curve 5 at the place of particular character 4. Most of the characters of the serial number are therefore tilted relative to lower edge 6 of engraved block 3, the foot of each character extending parallel to or on the tangent to curve 5. Additionally at least two characters 4 are at a different distance from lower edge 6 of their engraved block.

Two further embodiments of the inventive numbering apparatus for providing documents with a serial number are shown in FIGS. 4*a* and 4*b*. In FIG. 4*a* the serial number is disposed along wavy imaginary line 5, individual characters 4 of the serial number again being at a different distance from the lower edge of engraved block 3. In FIG. 4*b* the serial number is disposed along imaginary curve 5 having curvature 7 between the FIGS. 4 and 5.

Curved line 5 in the sense of the invention is therefore to be regarded as an imaginary, visible or detectable line which deviates from a straight connection from its beginning to its end in least at one place.

FIGS. 5*a* and 5*b* show two further examples of the inventive serial number. Individual figures 4 of the serial numbers are engraved on the engraved blocks so as to be disposed upright one below the other along arc 6, 6'. The serial number is thus readable from the top to the bottom. The arrangement of the characters along curved line 6, 6' arises on the engraved blocks from at least two characters of the serial number being at a different distance from right edge 8 or left edge 9 of engraved block 3.

The arrangement of the serial number along an imaginary, visible or detectable curved line can also be characterized, both for characters standing vertically one above the other and for ones standing horizontally side by side, in that at least one character of the serial number is at a distance from a straight connecting line from the first to the last character of the serial number. Equivalent reference points of a character must of course be selected for the beginning and the end point of this line, the remaining characters of the serial numbers then being disposed so that their equivalent reference points are at a distance from the straight connecting line from the first to the last character and the characters being disposed so as to lie along an imaginary, visible or detectable curved line.

Figure 6A:
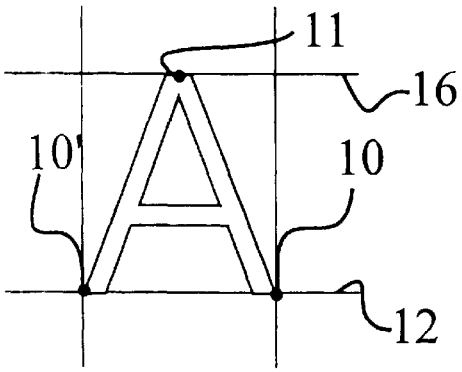
FIGS. 6*a–b* shows a representation of reference points of a character.
Figure 6B:
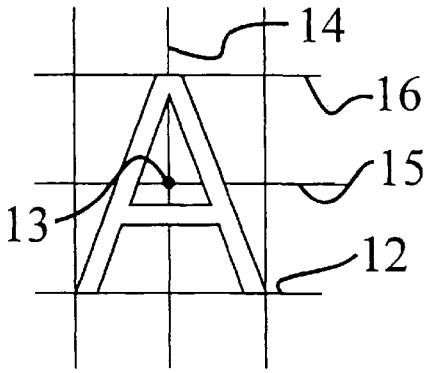

Suitable reference points are for example, as shown in FIG. 6*a*, one of outer contact points 10, 10' of the character with foot line 12, or contact point 11 of the character with head line 16. Equally suitable is center 13 of a character which, as shown in FIG. 6*b*, is defined as the intersection of the line through half the engraving width 14 with the line through half the height 15 of the character, half the height of the character being defined by half the distance from foot line 12 to head line 16 of the character.

Figure 7:
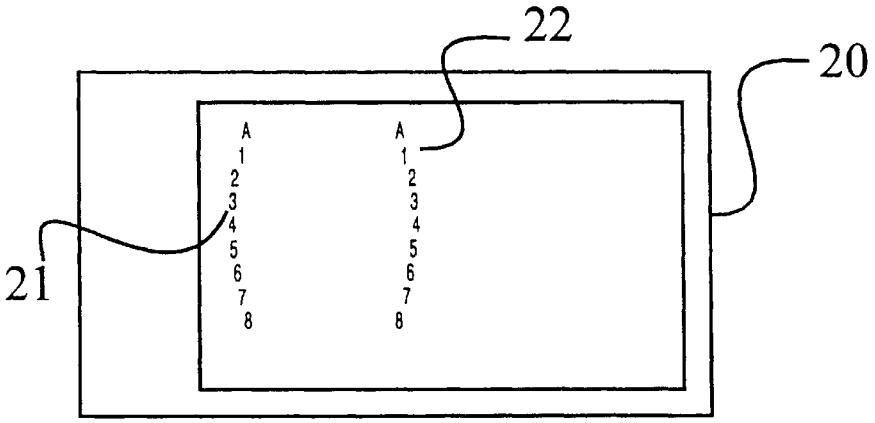
FIG. 7 shows a document of value with numbering.

The numbering apparatus can be used for numbering documents, for example bank notes, papers of value, identification or credit cards, passports or the like, the numbering being applied to the document one or more times and in different forms. FIG. 7 shows paper of value 20 which has two serial numbers 21 and 22 disposed along a curved line, the curved line itself not being recognizable on the document. The characters of the two serial numbers are in this case disposed vertically one below the other.

Figure 8:
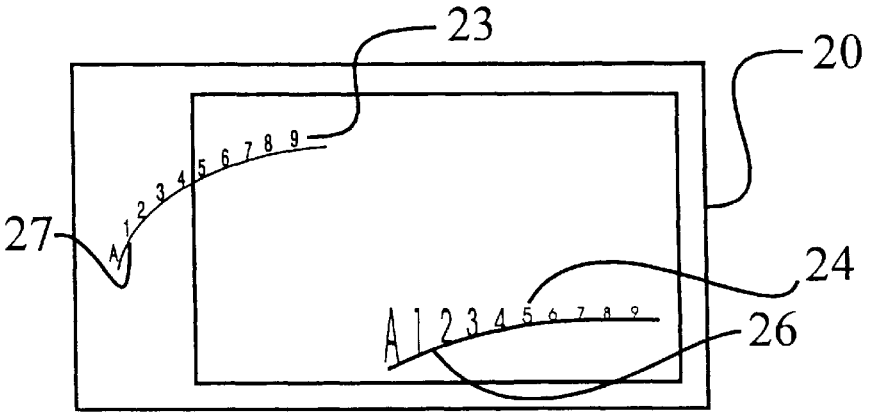
FIG. 8 shows a document of value with numbering.
Figure 12:
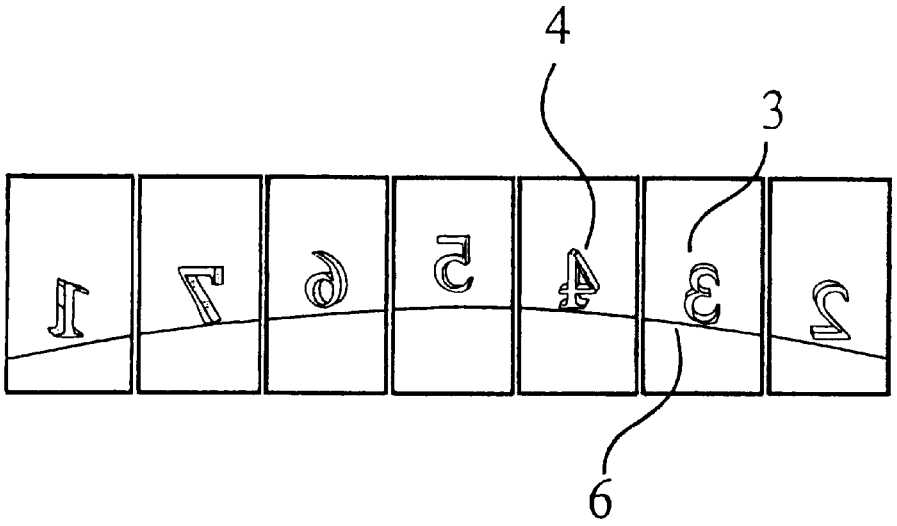
FIG. 12 shows a plan view of embossing blocks of numbering apparatus including a curved line portion on each blade.

For characters disposed side by side, FIG. 8 accordingly shows document 20 which has two serial numbers 23 and 24 again disposed along an imaginary, visible or detectable line having a curvature. In contrast to the variant shown in FIG. 7, curved lines 26 and 27 are to be seen on this data carrier. If these lines are intended to be visible on the data carrier, they can be applied together with the serial number using blocks as shown in FIG. 12, or be produced in separate printing operations. It is not necessary for the individual figures of a serial number to have a uniform appearance. Thus, serial number 24 is disposed in an arc shape along line 26, but the individual characters of the serial number have a different size. Using this change in size of the serial number one can apply a further additional security feature to the paper of value which impedes unauthorized imitation.

The selection of characters is not restricted to arabic numerals or alphanumeric characters. For example the figures shown in FIG. 9 and used in the Arabic speech area can likewise be used to represent serial number 25, and also combined with other characters.

Figure 10:
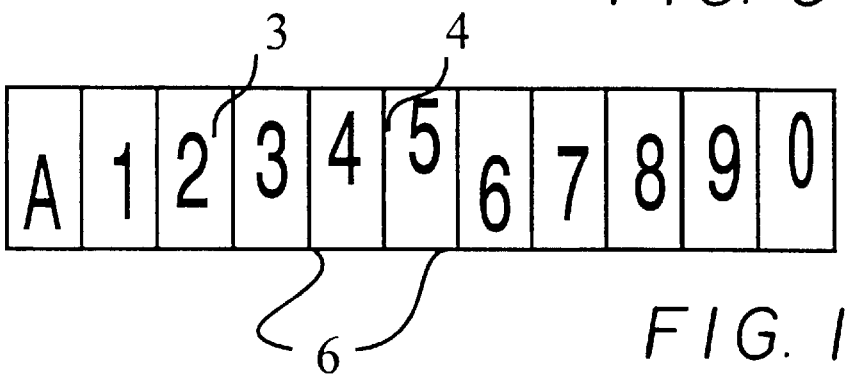
FIG. 10 shows a schematized arrangement of the figures on the engraved blocks of a numbering apparatus.

FIG. 10 shows that it is possible to individualize documents not only by merely stating the serial number but also by the geometrical arrangement of the characters in the serial number. For this purpose one assigns to the characters fixed positions on the engraved blocks which are the same on all figure wheels for a certain character. For example the distance of the foot or baseline of like characters from edge 6 of the embossed block can assume a fixed defined value for each of these like characters. In FIG. 10 this distance increases from the first character "A" through the FIGS. "1" to "4" to the sixth character "5". The same applies to the second part of the serial number from the seventh to the eleventh character. Thus, for all like characters there are defined and fixed positions within the serial number which also produce an individual geometrical arrangement of the figures for different serial numbers.

FIGS. 11*a* to d show four examples of this, indicating details from security document 20 on which different serial numbers 26 are printed with a numbering unit having engraved blocks with engraved characters according to FIG. 10. Comparison of FIGS. 11*a* to 11*d* clearly indicates that a change of the serial number also varies the geometrical arrangement of the serial number, i.e. the serial number is disposed along an imaginary curve which is individual for each serial number.

Figure 9:
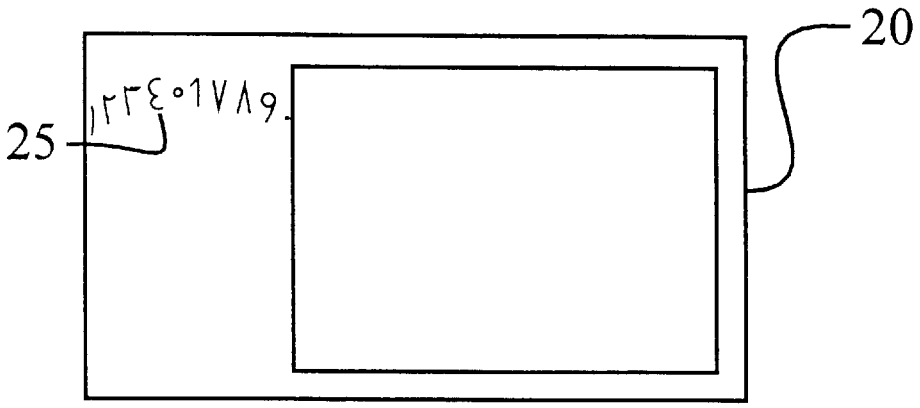
FIG. 9 shows a document of value with numbering.
Figure 11A:
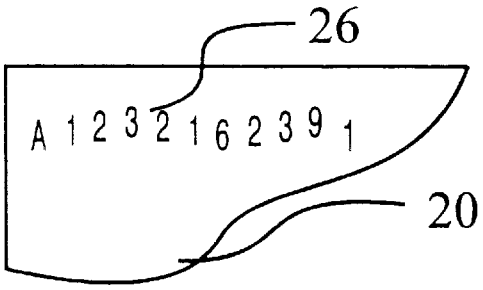
FIGS. 11*a–d* shows details of numbered documents.
Figure 11C:
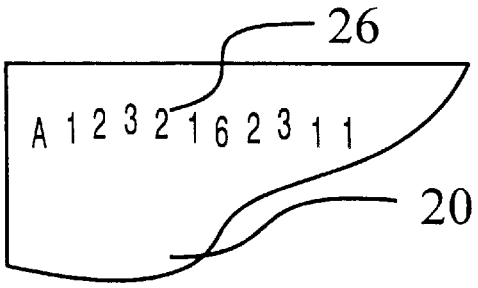
Figure 11B:
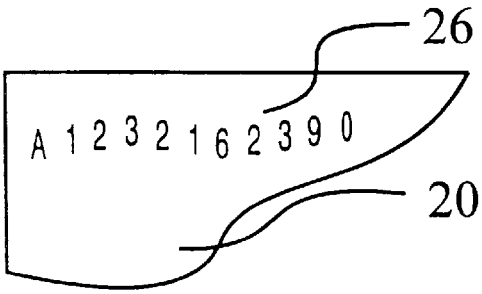
Figure 11D:
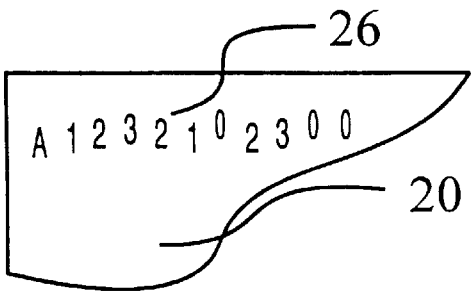

In FIG. 11*a* the serial number thus ends with the FIGS. 3 9 1 and in FIG. 11*b* with the FIGS. 3 9 0. Since the FIG. 1 on the engraved block is at a smaller distance from the lower edge of the engraved block than the FIG. 0, the serial numbers of FIGS. 11*a* and 11*b* differing only in the last figure have a clearly recognizable different appearance. FIGS. 11*c* and 11*d* again show for illustration two different serial numbers 26 on a detail of document 20. Like characters on the embossed block of the numbering unit are at the same distance from the lower edge of the embossed block so that they accordingly lie on a line and/or have the same orientation when printed on the document. In this way one can produce serial numbers which characterize a document through the number, on the one hand, and through the geometrical arrangement along different curved lines, on the other hand. As described in the previous examples, it is possible to produce the thus individualized serial numbers by fixing the position of the individual characters by different reference points. In addition, one can individualize like characters in their position on the embossed block by assigning to them a defined angle to a perpendicular on lower edge 6 of the embossed block, the angle or orientation being the same for like characters and different for different characters. In this way one can likewise achieve an individualization of the position of different characters on the embossed block, which in turn results in an individualization of the serial number going beyond mere individualization through the number.

It is of course possible in all examples to provide the serial numbers on the data carriers with additional security features, such as fluorescent, magnetic or electroconductive substances. In addition one can combine different forms of the serial number on one and the same document, i.e. apply several serial numbers to one and the same document, at least one of which is applied along an imaginary, visible or detectable line having a curvature. It is thereby irrelevant whether the figures of the serial number are applied vertically one below the other or horizontally side by side. It is likewise possible to apply the line which the serial number follows to the document so as to be readily visible, invisible or visible (detectable) only with the aid of technical means, such as UV lamps.

The serial number can furthermore be applied to documents without the use of embossed numbering units. It is in particular expedient to use so-called ink jet numbering apparatuses, whereby the serial number is applied to the document along a curve using an EDP-controlled ink jet printer.

What is claimed is:

1. A data carrier comprising a substrate medium provided with individualized and unique serial number indicia, said indicia comprising a string of individual characters extending along a curved line selected from the group consisting of imaginary, visible and detectable lines.

2. The data carrier of claim 1, wherein the line is arc-shaped.

3. The data carrier of claim 1, wherein the serial number indicia are repeatedly provided on the data carrier.

4. The data carrier of claim 3, wherein at least two lines along which the serial numbers are disposed have a different form.

5. The data carrier of claim 1, wherein at least two of said characters have different heights.

6. The data carrier of claim 1, wherein said characters are disposed upright side by side.

7. The data carrier of claim 1, wherein said characters are disposed upright one above the other.

8. The data carrier of claim 1, wherein at least two of said characters differ in their type font.

9. A serial number indicia imprinting device for imprinting a string of individual characters forming a serial number on a document of value, comprising:

at least one numbering unit having a plurality of figure wheels each having character blocks with individual characters engraved thereon, said characters located on each block so that when the blocks are positioned to form a serial number, a string of individual characters constituting the serial number extends along a curved line selected from the group consisting of imaginary, visible and detectable lines.

10. The number apparatus of claim 9, wherein the line is arc-shaped.

11. The numbering apparatus of claim 9, wherein the characters are disposed upright and side by side.

12. The numbering apparatus of claim 9, wherein the characters are disposed upright one below the other.

13. The numbering apparatus of claim 9, wherein at least two of said characters differ by their orientation relative to an edge of the character block.

14. The numbering apparatus of claim 9, wherein a part of said line is visible and is also engraved on each engraved block along with the character of the serial number.

15. The numbering apparatus of claim 9, wherein solely one individual character of said serial number is engraved on each block.

16. A serial number indicia imprinting device for imprinting a string of individual characters forming a serial number on a document of value, comprising:

at least one numbering unit having a plurality of figure wheels each having character blocks with individual characters engraved thereon, wherein like characters are angularly oriented the same way on separate individual character blocks, and different characters are angularly oriented differently on separate individual character blocks.

17. A serial number indicia imprinting device according to claim 16, wherein said like characters are also positioned in the same way on separate individual character blocks and different characters are positioned differently on separate individual character blocks.

18. A serial number indicia imprinting device for imprinting a string of individual characters forming a serial number on a document of value, comprising:

at least one numbering unit having a plurality of figure wheels each having character blocks with individual characters engraved thereon, wherein like characters are positioned in the same way on separate individual character blocks, and different characters are positioned differently on separate individual character blocks.

* * * * *

UNITED STATES PATENT AND TRADEMARK OFFICE

CERTIFICATE OF CORRECTION

PATENT NO. : 6,164,701

DATED : December 26, 2000

INVENTOR(S) : Gerhard Mürl

It is certified that error appears in the above-identified patent and that said Letters Patent is hereby corrected as shown below:

Cover page, Item [75]; change "Diesecke & Devrient GmbH," to --Giesecke & Devrient GmbH,--

Signed and Sealed this

First Day of May, 2001

*Attest:*

Nicholas P. Godici

NICHOLAS P. GODICI

*Attesting Officer*

*Acting Director of the United States Patent and Trademark Office*